US006209338B1

(12) United States Patent
Thatcher, Jr.

(10) Patent No.: US 6,209,338 B1
(45) Date of Patent: Apr. 3, 2001

(54) SYSTEMS AND METHODS FOR CONTROLLING REFRIGERANT CHARGE

(76) Inventor: William Bradford Thatcher, Jr., 1851 Anjaco Rd. NW., Atlanta, GA (US) 30309

( * ) Notice: Subject to any disclaimer, the term of this patent is extended or adjusted under 35 U.S.C. 154(b) by 0 days.

(21) Appl. No.: 09/347,128

(22) Filed: Jul. 2, 1999

Related U.S. Application Data

(60) Provisional application No. 60/093,036, filed on Jul. 15, 1998.

(51) Int. Cl.[7] ..... F25B 45/00
(52) U.S. Cl. ..... 62/292; 62/77; 62/149
(58) Field of Search ..... 62/149, 292, 77

(56) References Cited

U.S. PATENT DOCUMENTS 5,335,511 * 8/1994 McKeown ..... 62/174
5,381,669 * 1/1995 Bahel et al. ..... 62/129
5,481,883 * 1/1996 Harkness, Jr. et al. ..... 62/77
5,564,280 * 10/1996 Schilling et al. ..... 62/84
5,799,497 * 9/1998 Sano et al. ..... 62/149
6,070,420 * 6/2000 Biancardi et al. ..... 62/114
6,082,122 * 7/2000 Madenokouji et al. ..... 62/77
6,085,531 * 7/2000 Numoto et al. ..... 62/149

* cited by examiner

*Primary Examiner*—Corrine McDermott
*Assistant Examiner*—Mark Shulman
(74) *Attorney, Agent, or Firm*—Alston & Bird LLP

(57) ABSTRACT

A refrigerant storage reservoir, connected by valves to the high and low pressure lines of a refrigeration system, and controlled by a microprocessor based system that monitors temperatures and pressures, provides a means of regulating the overall amount of refrigerant charge in a heating or cooling system to optimize economy or performance during operation. Reference temperature and pressure data profiles, permanently stored in memory, are compared with actual data collected while the refrigeration system is operating. If a reduction of refrigerant charge is indicated, a valve on the high pressure side of the refrigeration system is opened to allow excess refrigerant to flow into the storage reservoir. If an increase in refrigerant charge is indicated, a valve on the low pressure side of the refrigeration system is opened to allow refrigerant to flow from the reservoir into the operating loop of the refrigeration system. In accordance with an alternative embodiment, the microprocessor based system stores temperature and pressure data collected during refrigeration system operation in a local Non-Volatile-Memory (NVM) and uses this self collected data to develop custom temperature and pressure data profiles that reflect the actual installed refrigeration system.

8 Claims, 7 Drawing Sheets

SYSTEMS AND METHODS FOR CONTROLLING REFRIGERANT CHARGE

CROSS REFERENCE TO RELATED APPLICATION

This application claims benefit of co-pending U.S. Provisional Application No. 60/093,036, entitled "Systems and Methods for Controlling Refrigerant Charge," filed Jul. 15, 1998.

FIELD OF THE INVENTION

The present invention generally relates to refrigeration systems used for heating and/or cooling purposes.

BACKGROUND OF THE INVENTION

The Heating Ventilating and Air Conditioning (HVAC) systems in use today use significant amounts of energy in accomplishing their designated task. Thus, it is desirable to make them operate efficiently and reduce the energy usage where ever possible. One drawback to most typical systems is that for cost and practical complexity reasons, they are designed to run at a fixed nominal operating point of maximum design efficiency. However, in typical use, the operating conditions span a large range above and below the nominal design point. When the typical HVAC system is running in the ranges above or below its design operating point, the system design is compromised. Worst case extremes are typically known so the system is designed to operate without sustaining damage, although not necessarily with optimum efficiency, at these extremes.

FIG. 1 illustrates a typical residential forced air HVAC split system comprised of an indoor unit 2 connected via refrigerant lines 4 to an outdoor unit 6. When the temperature inside the residence exceeds the set point of thermostat 8, the indoor unit 2 and the outdoor unit 6 are activated via signals in control lines 10 causing conditioned supply air to flow through duct 12 and be circulated throughout the residence. When the temperature reaches the set point of thermostat 8 the signals in the control lines 10 change and the indoor unit 2 and the outdoor unit 6 are switched off. The equipment remains at rest until the set point of thermostat 8 is exceeded once again.

FIG. 2 is a block diagram of a prior art HVAC refrigeration system suitable for use in the forced air HVAC split system of FIG. 1. Briefly described, a refrigerant gas is compressed by a compressor 20 and flows through line 21 to a condenser 22 where it is cooled and condensed to liquid by a heat exchange media circulator 24. The pressurized liquid refrigerant flows through line 26 to an evaporator 28 where it is heated and evaporated to a gas by a heat exchange media circulator 30. The resulting low pressure gaseous refrigerant flows through line 32 from the evaporator 28 back to the compressor 20 completing the cycle. Typically the compressor 20 will run at a constant speed, and the ability of the HVAC system to adapt to changes in the applied refrigeration load, such as seasonal changes, is limited. For example, in many cases, the heat exchange media flowing through the evaporator 28 can be moisture laden air or circulating water. Care must be taken to insure that a practical HVAC refrigeration system does not allow the evaporator temperature to fall below the freezing point of water. When moisture laden air contacts the evaporator 28 and the temperature of the evaporator 28 is below the dew point of the moisture laden air, the moisture in the air will condense on the surface of the evaporator 28. If the temperature of the evaporator 28 were allowed to fall below the freezing point of water, the moisture in the air passing through the evaporator would not only condense to a liquid state (water) but would also continue to cool further to freeze to a solid state (ice). If the heat exchange surface of the evaporator 28 becomes coated with ice, initially efficiency is reduced and ultimately all flow of air blocked. Likewise, in the case where the heat exchange media through the evaporator 28 is circulating water, the temperature of the evaporator 28 must be maintained above the freezing point of water to prevent ice from building up and blocking the flow of the circulating water.

A variety of regulating valves and variable orifices have been employed in conventional systems to control the expansion of the refrigerant in the evaporator and regulate the temperature in the evaporator to prevent such freezing conditions. They operate by reducing the flow of refrigerant through the evaporator. Unfortunately, reducing the flow through the evaporator may cause excessive pressure to build up in the condenser as the compressor continues to run. When condenser pressure increases, more energy may be unnecessarily consumed by the compressor. Many residential HVAC systems employ capillary tubing to control the expansion in the evaporator. While generally cost effective and reliable, capillary tubing function is fixed and cannot adjust to control the temperature in the evaporator. These systems with capillary tubing rely on a critical ideal amount of refrigerant charge in the system to achieve optimal performance. Because the refrigerant charge is fixed, this optimal performance is only achieved at one operating point.

Further problems are caused because the fixed refrigeration charge is typically added to the HVAC system during field installation. Often in the field, the lengths of refrigeration tubing between the indoor and outdoor units are not exactly known and thus the required ideal refrigerant charge is approximated by the tradesman preforming the installation. The resulting installed HVAC system typically operates in a compromised mode over varying load conditions such as presented by seasonal and daily weather changes. Occasionally it may operate at its ideal efficiency when the load conditions happen to coincide with the load conditions that correspond to the ideal load for the actual installed refrigerant charge. Additionally, although designed to be completely sealed, refrigerant can leak from sealed systems by escaping through fine cracks in fittings and welded connections, porous sections of castings, compressor shaft seals, and testing and servicing ports. The slow but continuous migration of refrigerant out of an operating refrigeration system may cause the ideal operating point of that system to change as the total refrigerant charge is reduced. Thus, an unresolved need continues to exist in the industry for systems and methods that enable more efficient operation of HVAC systems over a wider range of environmental operating conditions.

In a conventional system, such as illustrated in FIGS. 1 and 2, the fixed capacity of the HVAC system components are typically estimated according to the size and thermal loading of the residence at the maximum or worst case condition. However, in actual use, the operating conditions vary widely as the outdoor temperature and humidity varies on a day-by-day and hour-by-hour basis. Accordingly, the HVAC system is often not operating at its point of maximum design efficiency.

SUMMARY OF THE INVENTION

It is an object of this invention to vary the amount of refrigerant charge in a HVAC system to achieve optimum energy efficiency and optimum performance over a wide range of environmental operating conditions.

In accordance with the present invention, refrigerant storage reservoir connected via two valves to a HVAC refrigeration system and controlled by a microprocessor control system using fixed stored tables of temperature and pressure data selectively adds and removes refrigerant from the operating system to achieve optimal results.

In accordance with an alternative embodiment, the tables of temperature and pressure data are collected locally over a period of time by a learning routine in the microprocessor control system and stored in a non-volatile memory associated with the microprocessor control system.

The present invention is particularly useful and offers significant improvement in refrigeration systems that have to work in wide operating ranges. For example, automobile and residential cooling, particularly heat pump applications where reversing the cycle creates a very wide effective operating range.

Other features and advantages of the present invention will become apparent to one that is skilled in the art upon examination of the following drawings and detailed description. It is intended that all such additional features and advantages be included herein within the scope of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
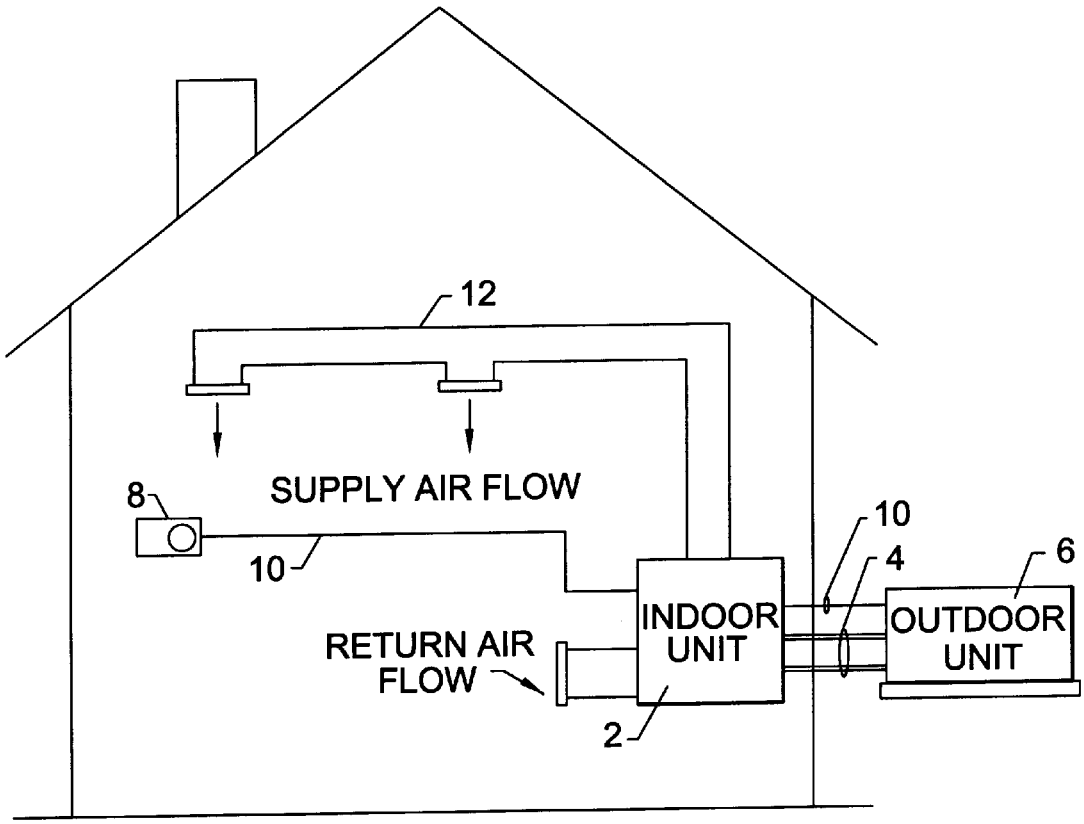
FIG. 1 is an illustration of a typical fixed capacity residential HVAC system.
Figure 2:
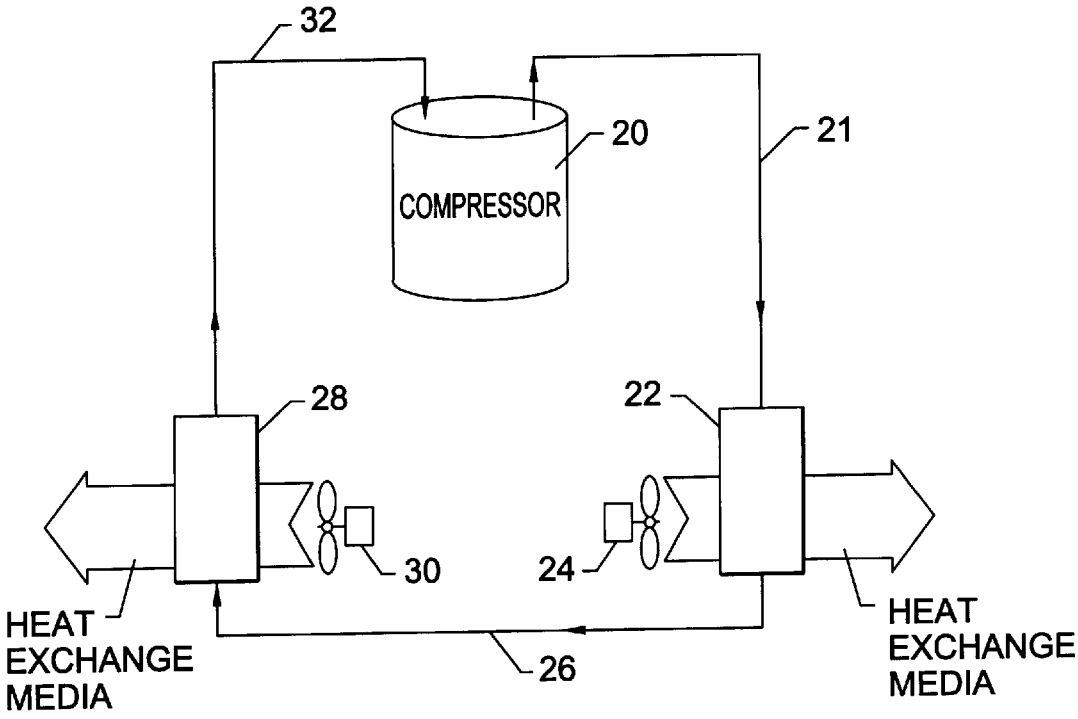
FIG. 2. (PRIOR ART)
FIG. 2 is a block diagram of a prior art HVAC refrigeration system suitable for use in the fixed capacity residential HVAC system.
Figure 3:
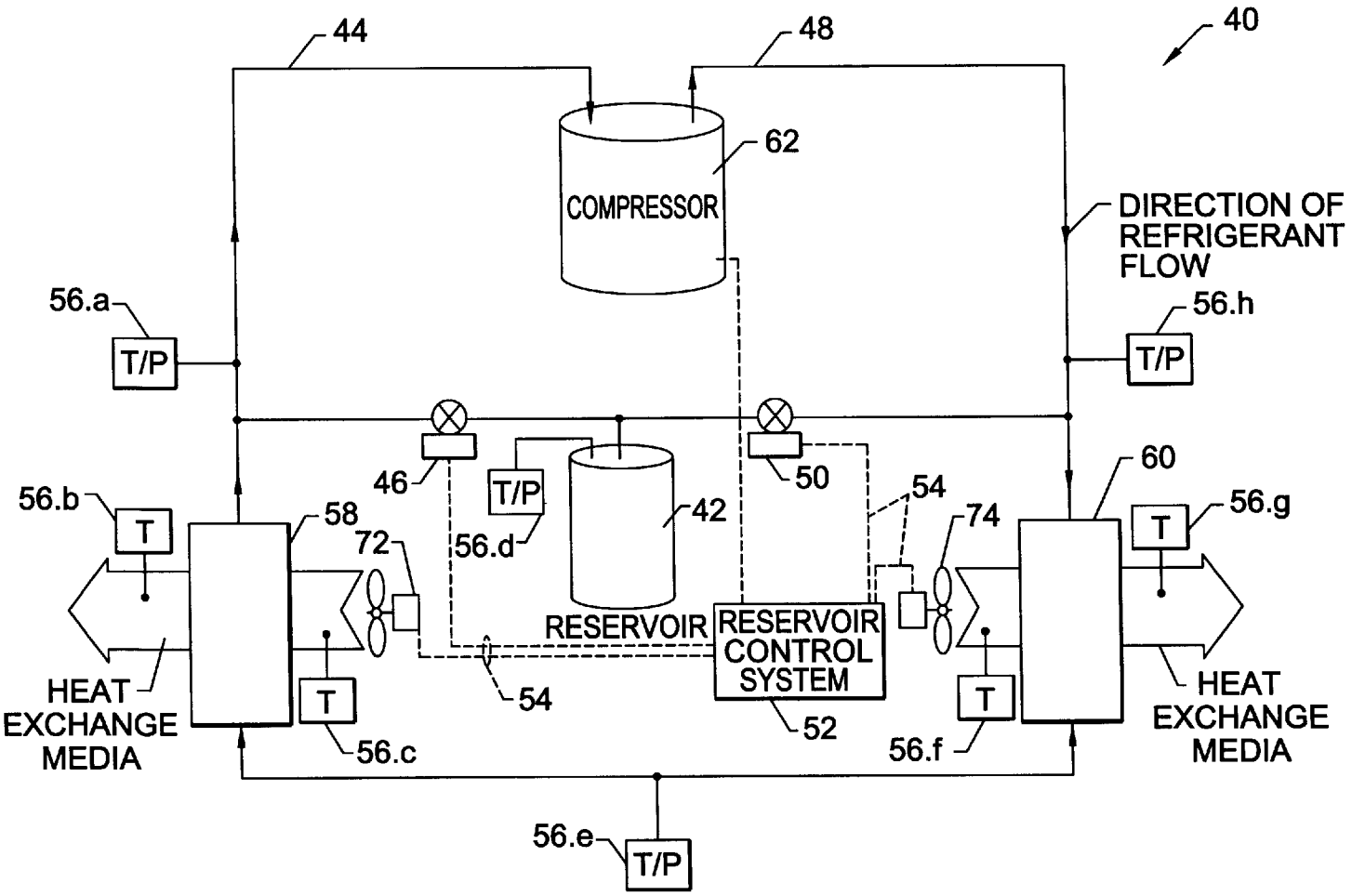
FIG. 3 is a block diagram of a HVAC embodiment of the present invention.

With reference now to FIG. 3, an embodiment of a HVAC refrigerant system 40 in accordance with the present invention is illustrated. In system 40, a refrigerant reservoir 42 is connected to the low pressure gaseous refrigerant line 44 via a valve 46 and to the high pressure liquid refrigerant line 48 via a valve 50. A reservoir control system 52 is connected via the control lines 54 to the valves 46 and 50. Temperature (T) and combined Temperature and Pressure (T/P) sensors 56*a*–56*h* are located at a variety of points throughout the system to provide data to the reservoir control system 52 via control lines (not shown). The T/P sensor 56*a* is configured to provide the temperature and pressure data of the low pressure expanded gaseous refrigerant exiting the evaporator 58 and entering the compressor 62. The T sensor 56*b* is configured to provide the temperature data of the heat exchange media exiting the evaporator 58. The T sensor 56*c* is configured to provide the temperature data of the heat exchange media entering the evaporator 58. The T/P sensor 56*d* is configured to provide the temperature and pressure data of the refrigerant stored in the reservoir 42. The T/P sensor 56*e* is configured to provide the temperature and pressure data of the high pressure liquid refrigerant exiting the condenser 60 and entering the evaporator 58. The T sensor 56*f* is configured to provide the temperature data of the heat exchange media entering the condenser 60. The T sensor 56*g* is positioned to provide the temperature data of the heat exchange media exiting the condenser 60. The T/P sensor 56*h* is configured to provide the temperature and pressure data of the high pressure gaseous refrigerant exiting the compressor 62 and entering the condenser 60. The heat exchange media may be fitted with temperature sensors which provide temperature data, as indicated. The combined T/P sensors are used to provide data on both the temperature and pressure of the refrigerant in a specified system component. By using stored characteristic data provided by the refrigerant manufacturer and the retrieved temperature and pressure data from one or more of sensor 56*a*–56*h*, the reservoir control system 52 can determine the liquid or gaseous phase state of the refrigerant. Appropriate action can be taken by the reservoir control system 52 to adjust the refrigerant charge to prevent excess liquid state refrigerant in refrigerant line 44 from entering the compressor 62 and causing damage to internal compressor components.

For example, care should be taken to insure only gaseous refrigerant enters the compressor. Compressor damage, sometimes referred to as "slugging" in the industry, may result if non-compressible liquid enters the compressor. The compressor is designed to compress gaseous refrigerant. When liquid state refrigerant is allowed to enter the compressor, severe and damaging shock loads are created as the moving parts of the compressor, intended to contact a gas, strike the much more dense liquid refrigerant.

Slugging can become a chronic problem that occurs when operating temperatures of the heat exchange media flowing through the condenser are at the low end of the specified range for normal design operation Such conditions exist when the refrigeration system has more capacity than is necessary to handle the applied refrigeration load. For example, operating a residential cooling system in the fall, when it is cool outside, and nearly cool enough inside, results in an over capacity situation. The condenser provides very cool liquid refrigerant to the evaporator and the internal circulating air of the house does not contain enough heat to evaporate it all. Yet the compressor keeps running, forcing the refrigerant through the system. If enough unevaporated (liquid) refrigerant builds up in the evaporator, it may be forced into the compressor which can cause slugging damage. Therefore, in accordance with the present invention, the reservoir control system 52 can perform corrective action to prevent slugging by opening valve 50 and allowing some of the excess refrigerant to flow into the reservoir 42.

The heat exchange media is preferably water or air. Its phase state is not generally critical to the refrigerant cycle, and at typical practice pressures, knowing the temperature is usually sufficient to know the state of the media. For example, when water is used, monitoring the temperature alone is sufficient to prevent freezing at approximately 32° F. or boiling at 212° F.

By selectively activating valves 46 and 50, the reservoir control system 52 is able to increase or decrease the refrigerant charge in the refrigeration system 40 while it is operating, and thereby allowing the refrigeration system to adapt to the local environmental circumstances to achieve the most effective operating condition.

It is noted that the refrigeration system 40 is shown in FIG. 3 in a simplified and general configuration to clearly describe the present invention. For instance, typical heat pump configurations employ a reversing valve to interchange the physical positions of the condenser 60 and evaporator 58 for the purpose of switching between providing heating or cooling functions. Nonetheless, the invention is equally applied to heat pump configurations with reversing valves as well as standard fixed function systems. The function of the reversing valve is well known and is not included in the figures for simplification purposes.

Figure 4:
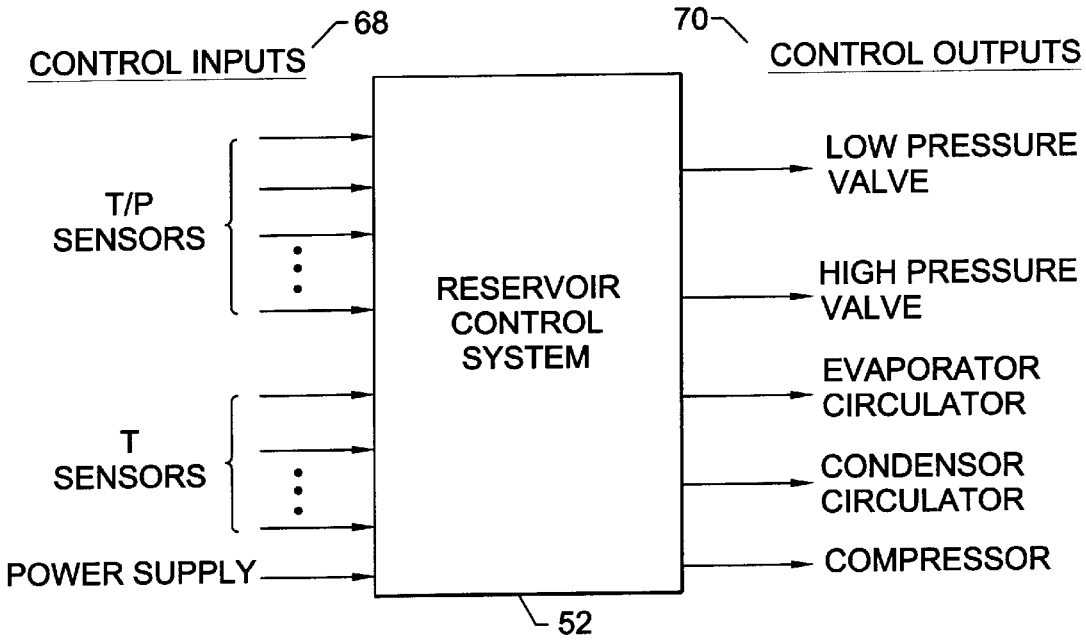
FIG. 4 is a block diagram illustrating the inputs and outputs of the reservoir control system of FIG. 3.

FIG. 4 illustrates the inputs and outputs of the reservoir control system 52 of FIG. 3. The control inputs 68 are connected to the T and T/P sensors 56*a* through 56*h* and a power supply. The control outputs 70 are connected to the low pressure valve 46, high pressure valve 50, evaporator circulator 72, condenser circulator 74, and compressor 62.

Figure 5:
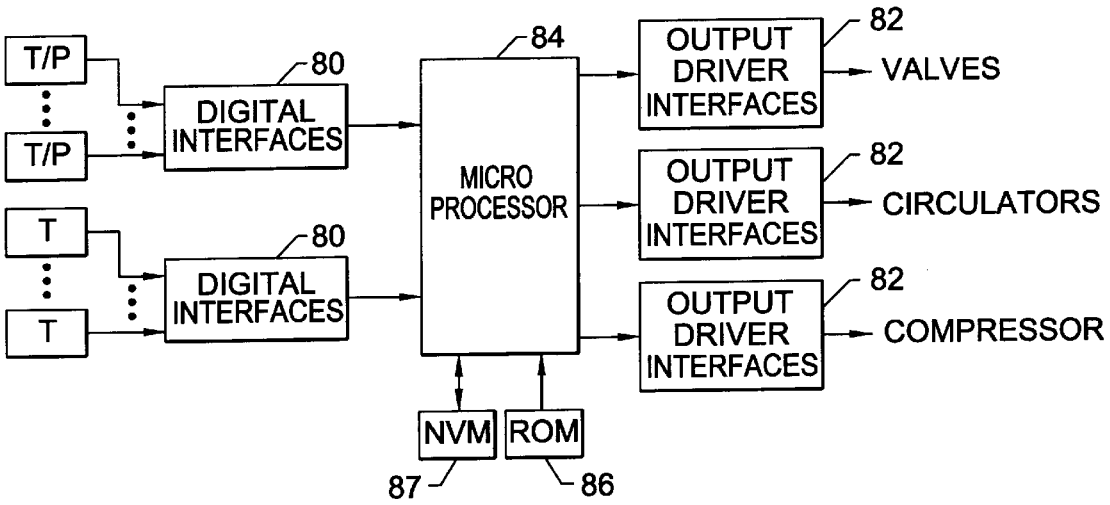
FIG. 5 is a schematic block diagram of the reservoir control system of FIG. 3.

FIG. 5, a schematic diagram of the reservoir control system 52 in accordance with an embodiment of the present invention is shown. Digital interfaces 80 interface to the T and T/P sensors 56*a* through 56*h* and provide signal conditioning, transient protection, and signal processing as necessary to convert analog temperature and pressure sensor signals to digital data. Output driver interfaces 82 interface the valves 46 and 50, circulators 72 and 74, and compressor 62, and provide signal conditioning, transient protection, and signal processing as necessary to convert digital data to analog signals. A microprocessor 84 receives digital temperature and pressure data from the digital interfaces 80, provides outputs via the output driver interfaces 82 to valves 46 and 50, circulators 72 and 74, and compressor 62, and retrieves fixed temperature and pressure data profiles stored in memory, such as from read-only memory (ROM) 86. In accordance with an alternative embodiment of the present invention, in addition to fixed temperature and pressure data profiles, microprocessor 84 may also store custom local temperature and pressure data profiles in memory, such as non-volatile memory (NVM) 87, and retrieves the custom local temperature and pressure data profiles from NVM 87, as described below.

Figure 6:
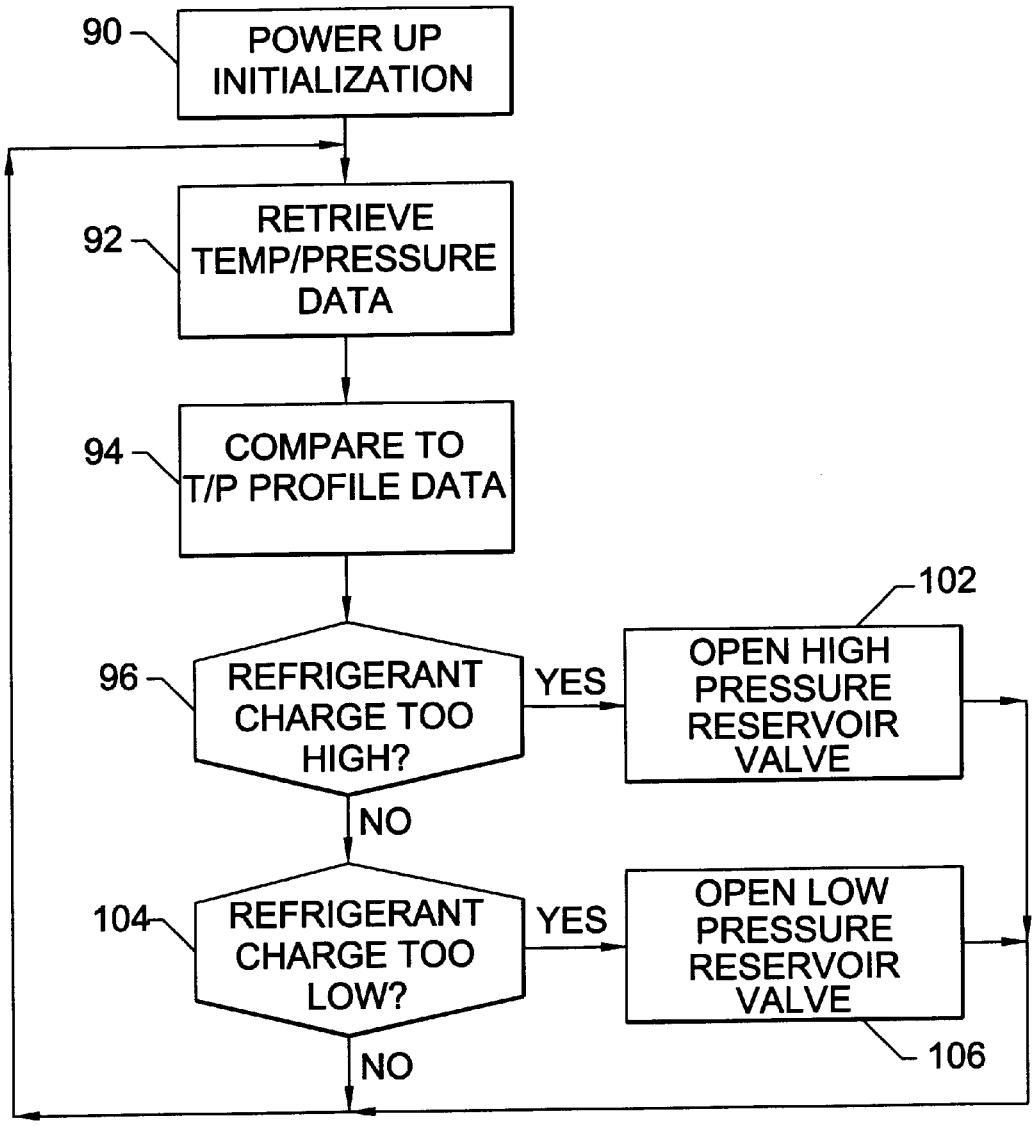
FIG. 6 is a flow chart of the microprocessor software routine in accordance with an embodiment of the present invention wherein the temperature and pressure data is fixed and stored in memory.

FIG. 6 is a flow chart of the operation and sequence of events of the microprocessor 84 programmed in accordance with an embodiment of the present invention. At power up, the microprocessor initializes the internal settings and defines the states of the outputs, as indicated by block 90. Next, at block 92, the temperature and pressure data is retrieved from all input sensors. The data retrieved is then compared with the fixed stored temperature and pressure profile data stored in ROM 29, as indicated by block 94. Based on the comparison of the data at block 94, it is determined at block 96 if the refrigerant charge is too high, and if true, then the high pressure reservoir valve 50 is momentarily opened as indicated by block 102. The process then repeats, starting at block 92. If the refrigerant charge is not too high, then it is determined if the refrigerant charge is too low at block 104. If the refrigerant charge is too low, then the low pressure reservoir valve 46 is momentarily opened, as indicated by block 106. The process then repeats, starting at block 92.

Figure 7:
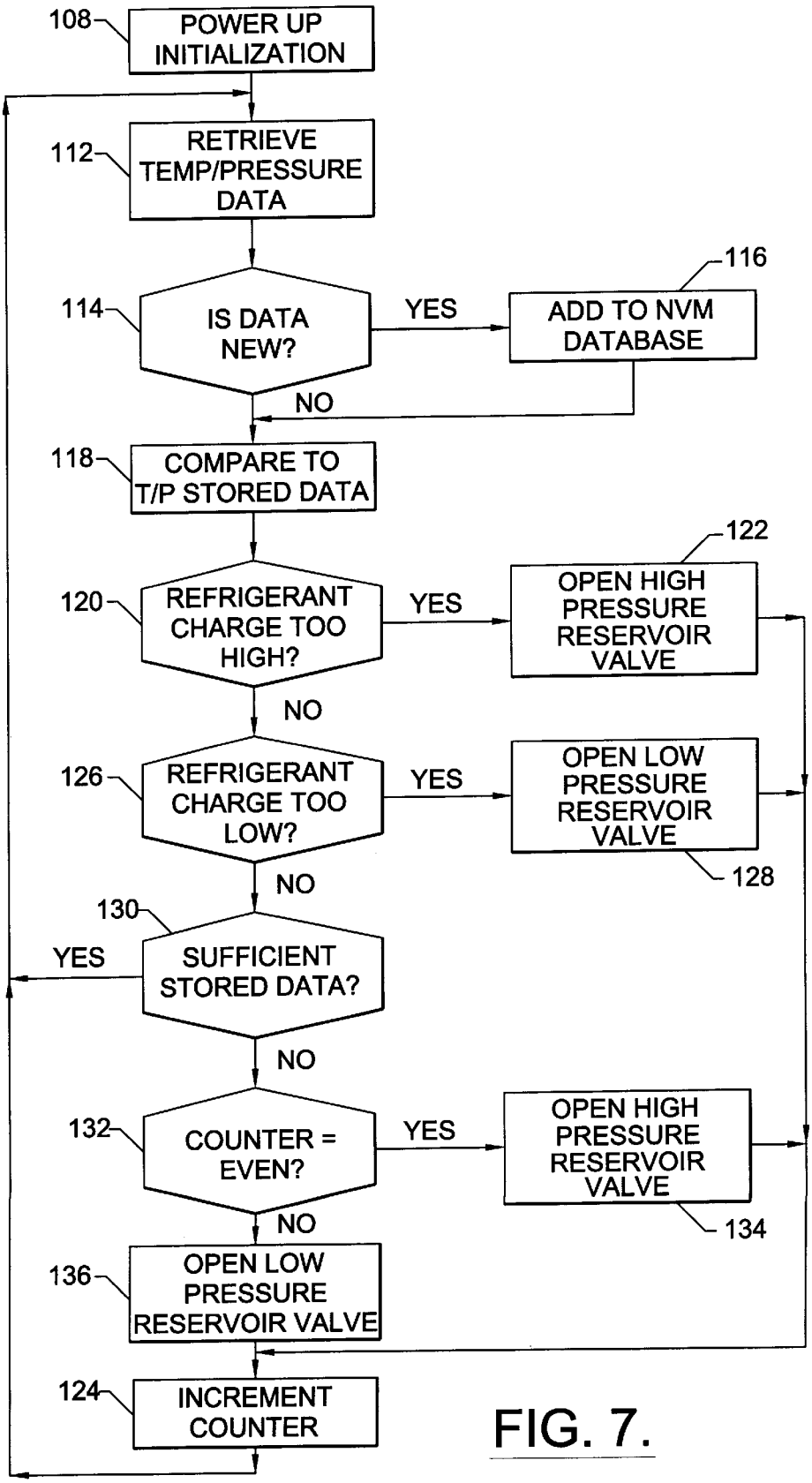
FIG. 7 is a flow chart of the microprocessor software routine used in accordance with an alternative embodiment of the present invention wherein the temperature and pressure data is collected locally by a learning process in the microprocessor, complied and stored in memory.

FIG. 7 is a flow chart of the operation and sequence of events of the microprocessor 84 programmed in accordance with an alternate embodiment of the present invention. At power up, the microprocessor 84 initializes the internal settings and defines the states of the outputs as indicated by block 108. Next, the temperature and pressure data is retrieved from the sensors 56*a*–56*h*, as indicated by block 112. It is then determined if the currently retrieved data is new by comparing retrieved data to previous data stored in the NVM as indicated by block 114. If the data is new, then the new data is added to the data in the NVM, as indicated by block 116. By adding new data values as they occur through the normal random course of operation, the microprocessor 84 is building a self generated database of temperature and pressure data. Then the retrieved data is compared to the custom temperature and pressure data stored in NVM, as indicated by block 118. Based on the comparison of the data at block 118, it is determined at block 120 if the refrigerant charge is too high. If the charge is too high, then the high pressure reservoir valve is momentarily opened, as indicated by block 122. The process then increments a counter, as indicated by block 124, and then returns to retrieve temperature and pressure data at block 112. If the charge is not too high, it is then determined at block 126 if the refrigerant charge is too low, and if true, then the low pressure reservoir valve is momentarily opened, as indicated by block 128. The process then increments the counter, as indicated by block 124, and returns to retrieve temperature and pressure data at block 112. If the charge is not too low, then it is determined if there is a sufficient number, as defined by preset guidelines, of stored data, as indicated by block 130. The preset guidelines for the number of data required to be sufficient are selected by the system designer in order to achieve the functional requirements of the practical refrigeration machinery that is being controlled. The preset guidelines for the number of stored data specify how many historical stored data retrievals are necessary before the microprocessor 84 is allowed to used that data for determining a course of corrective action. The value of these preset guidelines can vary from one application to another depending upon the specific functional requirements of the refrigeration system being controlled. If there is sufficient stored data, then no action is taken and the process returns to retrieve temperature and pressure data at block 112. If data is retrieved and steps 120 and 126 determine no change to the refrigerant charge is necessary, and there is only one set, or too few sets as determined by preset guidelines, of data for that operating point, the sufficient stored data decision of block 130 is no. If the sufficient stored data decision is no, then there is insufficient stored data to determine a confirmed course of action. The microprocessor 84 then begins a learning process to obtain more data by taking a random step to introduce changes to the system 40 to produce new data points that will add to the self generated data base.

Thus, the system 40 can move the refrigerant charge up and down around an operating point to collect more data and perhaps find a better set of operating data as determined by pre-selected optimization guidelines. For example, the counter is checked for an even value at block 132, and if it is even, then the high pressure reservoir valve is momentarily opened, as indicated by block 134. The process then increments the counter at block 124, and then returns to retrieve temperature and pressure data at block 112. If the counter is not even, then the low pressure reservoir valve is momentarily opened at block 136, the counter is incremented at block 124, and then returns to retrieve temperature and pressure data at block 112.

The alternative embodiment illustrated in FIG. 7 is particularly advantageous in refrigeration systems that are assembled in the field where installation conditions can vary from site to site. For example, the alternative embodiment in FIG. 7 uses locally collected data to supplement the standard reference data stored in ROM 86. By collecting local data, it is possible to have several sets of operating data that correspond to any one ambient operating point as determined by the temperatures at sensors 56*c* and 56*f*. The system experiments by adding or removing refrigerant to see if the system performance can be improved over the standard stored data in ROM 86. The experimental results are stored in the NVM 87. Improvement is determined by specific guidelines designed to optimize efficiency or any other specified operating parameter. When the local operating point data from sensors 56*c* and 56*f* is retrieved, the microprocessor 84 is able to access fixed reference data from ROM 29 as well as locally stored data in NVM 87 and choose which data provides the best operating performance based on specific guidelines designed to optimize efficiency, or any other specified operating parameter.

For example, instead of efficiency as the primary objective, the system could be designed to maintain a constant temperature at the heat exchange media exiting the evaporator 58 as sensed by T sensor 56*b*. Where a typical system without this invention might cycle on and off, a system using the alternate embodiment of the present invention could run continuously, and vary the refrigerant charge as necessary to keep a constant temperature at the evaporator 58, all the while making sure high and low pressure extremes for the system hardware are not exceeded.

It is noted that when actuated, the pressure valves 46 and 50 momentarily open for a fixed time and then re-close. They are opened by the reservoir control system 52 for the number of times necessary to achieve the desired result, as determined by comparing the retrieved temperature and pressure data. The minimum time for pressure valves 46 and 56 to be open would be determined by the mechanical time constants of the valve used. A typical time for the valves to be open would be 1 second. However, the reservoir control system 52 would cycle through its software routine at high speed, for example a thousand times per second. Thus, a delay should be incorporated into the operating logic of the reservoir control system 52 to allow the system to settle and adjust to a revised refrigerant charge, though this is not shown in FIGS. 6 and 7 in order to simplify the flowcharts.

The logical comparison steps 94 (FIG. 6) and 118 (FIG. 7) of the retrieved temperature and pressure data with the fixed ROM 86 stored data and NVM 87 stored data, respectively, involves multiple calculations and processes. All the data is validated by comparing for consistency in multiple readings over a prescribed period of time, insuring that it is indeed valid operating data and not partial or transient data produced, for example, by recent switching of system components. The operating point of the system is determined by reading the heat exchange media input temperatures from sensors 56*c* and 56*f*. These temperatures determine the size of the refrigeration load presented to the given installed refrigeration hardware. The data tables in ROM 86 are accessed and the optimum temperature and pressures for the refrigerant as sensed at the sensor locations 56*a*, 56*h*, and 56*e* for the conditions corresponding to the temperatures from the heat exchange media sensors 56*c* and 56*f* are transferred into registers in microprocessor 84. Interpolation is used if data exactly corresponding to the readings of 56*c* and 56*f* are not available in ROM 86 stored data. The retrieved data from sensors 56*a*, 56*h*, and 56*e* is compared to the optimum data from ROM 86 stored data, having been previously moved into registers to facilitate comparison. Comparison is achieved by mathematically evaluating the retrieved data for greater than, equal to, less than and difference magnitude relationships with the stored data for each of the individual sensors 56*a*, 56*h*, and 56*e*. If the retrieved pressure data from sensors 56*a*, 56*c*, and 56*f* is higher than the ROM 86 stored data, the refrigerant charge is too high. If the retrieved pressure data from sensors 56*a*, 56*c*, and 56*f* is lower than the ROM 86 stored data, the refrigerant charge is too low. For each set of retrieved data from sensors 56*a*, 56*h*, and 56*e*, the temperature and pressure data is also compared to the stored refrigerant characteristic data provided by the refrigerant manufacturer to confirm that the refrigerant's liquid or gaseous phase state is correct for each sensor location respectively. Correct refrigerant phase state conditions are included with the fixed stored temperature and pressure profile data stored in ROM 86. A predetermined data margin calculation is performed to insure that the refrigeration system operates within limits to prevent incorrect phase refrigerant at each of the individual sensors 56*a*, 56*h*, and 56*e*.

For example, the following is an example set of optimum operating data corresponding to the condition of 85° F. outside ambient air and 78° F. indoor return air as stored in ROM 86 for a typical set of refrigeration hardware using refrigerant R-22:

T sensor 56*c* 78° F.

T sensor 56*f* 85° F.

T/P sensor 56*a* 45° F., 70 psig

T/P sensor 56*e* 90° F., 180 psig

T/P sensor 56*h* 140° F., 185 psig

Following next are two sets of example retrieved sensor data:

A. Retrieved sensor data example set #1:

T sensor 56*c* 78° F.

T sensor 56*f* 85° F.

T/P sensor 56*a* 35° F., 65 psig

T/P sensor 56*e* 88° F., 160 psig

T/P sensor 56*h* 95° F., 165 psig

A comparison of the retrieved pressures with the stored optimum pressures indicates retrieved pressures are lower than the optimum operating pressures. Thus, the refrigerant charge is too low.

B. Retrieved sensor data example set #2:

T sensor 56*c* 78° F.

T sensor 56*f* 85° F.

T/P sensor 56*a* 50° F., 85 psig

T/P sensor 56*e* 98° F., 200 psig

T/P sensor 56*h* 150° F., 205 psig

A comparison of the retrieved pressures with the stored optimum pressures indicates retrieved pressures are higher than the optimum. Thus, the refrigerant charge is too high.

In the drawings and specification, there have been disclosed typical preferred embodiments of the invention, and although specific terms are employed, they are used in a generic and descriptive sense only, and not for the purposes of limitation; the scope of the invention being set forth in the following claims.

That which is claimed:

1. A refrigeration system, comprising:

a compressor that receives low pressure refrigerant and generates high pressure refrigerant;

a condenser that receives the high pressure refrigerant from the compressor and condenses the refrigerant to produce a liquid refrigerant;

an evaporator that receives the liquid refrigerant from the condenser and evaporates the liquid refrigerant to produce a low pressure refrigerant that is delivered to the compressor; and a reservoir system that selectively adds refrigerant to the low pressure refrigerant and removes refrigerant from the high pressure refrigerant to change the refrigerant charge to obtain a desired operational characteristic, wherein the reservoir system includes locally collected temperature and pressure data to which the temperature and pressure data from the temperature and pressure sensors is compared in determining whether to add or remove refrigerant.

2. The system of claim 1, wherein the reservoir system includes a refrigerant reservoir coupled to a low pressure valve for adding refrigerant system to the refrigeration and coupled to a high pressure valve for removing refrigerant from the refrigeration system.

3. The system of claim 2, wherein the reservoir system further includes a microprocessor that controls the operation of the low pressure valve and the high pressure valve.

4. The system of claim 1, further comprising temperature and pressure sensors coupled to the refrigeration system to providing the reservoir system with temperature and pressure data for use in determining if the refrigerant charge should be changed.

5. A method for controlling the refrigerant charge in a refrigeration system, comprising:

analyzing temperature and pressure data from the refrigeration system to determine if refrigerant charge should be changed to obtain a desired operational characteristic, wherein analyzing the temperature and pressure data comprises collecting and storing local temperature and pressure data and comparing the temperature and pressure data to the stored local temperature and pressure data;

adding refrigerant to the refrigeration system if the refrigerant charge is below a predetermined minimum; and removing refrigerant from the refrigeration system if the refrigerant charge is above a predetermined maximum.

6. The method of claim 5, wherein the step of comparing comprises a step of comparing to stored temperature and pressure data collected locally to the refrigeration system.

7. The method of claim 5, wherein the step of adding refrigerant comprises a step of adding refrigerant from a refrigerant reservoir to a low pressure refrigerant flow in the refrigeration system.

8. The method of claim 5, wherein the step of removing refrigerant comprises a step of removing refrigerant from a high pressure refrigerant flow of the refrigeration system to a reservoir.

* * * * *